US007772481B2

(12) United States Patent
Aimi

(10) Patent No.: US 7,772,481 B2
(45) Date of Patent: Aug. 10, 2010

(54) SYNTHETIC DRUM SOUND GENERATION BY CONVOLVING RECORDED DRUM SOUNDS WITH DRUM STICK IMPACT SENSOR OUTPUT

(75) Inventor: Roberto M. Aimi, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 995 days.

(21) Appl. No.: 11/196,815

(22) Filed: Aug. 3, 2005

(65) Prior Publication Data

US 2005/0257671 A1 Nov. 24, 2005

(51) Int. Cl.
*G10H 3/00* (2006.01)

(52) U.S. Cl. ..... 84/723; 84/600; 84/735; 84/736; 84/737; 84/107

(58) Field of Classification Search ..... None
See application file for complete search history.

(56) References Cited

U.S. PATENT DOCUMENTS

| | | | | |
|---|---|---|---|---|
| 6,753,467 | B2 * | 6/2004 | Tanaka et al. | 84/723 |
| 6,756,535 | B1 * | 6/2004 | Yoshino et al. | 84/738 |
| 2004/0200338 | A1 * | 10/2004 | Pangrle | 84/724 |
| 2005/0257672 | A1 * | 11/2005 | Arimoto | 84/738 |
| 2005/0262991 | A1 * | 12/2005 | Arimoto | 84/735 |

* cited by examiner

*Primary Examiner*—Marlon T Fletcher
(74) *Attorney, Agent, or Firm*—Charles G. Call

(57) ABSTRACT

Methods and apparatus for simulating the sound of an acoustic percussion instrument. A first stored waveform signal representative of the impulse response of an acoustic percussion instrument is convolved with a waveform produced by a sensor circuit attached to a physical playing surface. Undesirable response characteristics of the playing surface and sensor circuit may be filtered out by deconvolving sensor output, or the stored waveform representing the acoustic instrument, with the impulse response of the combination of the playing surface and the sensor circuit.

15 Claims, 1 Drawing Sheet

SYNTHETIC DRUM SOUND GENERATION BY CONVOLVING RECORDED DRUM SOUNDS WITH DRUM STICK IMPACT SENSOR OUTPUT

FIELD OF THE INVENTION

This invention relates to an electronic percussion system that simulates the sound of an acoustic percussion instrument.

BACKGROUND OF THE INVENTION

Electronic counterparts have been developed for many different acoustic instruments. With the successful adoption of electronic keyboards and guitars, and the advent of a rich variety of synthetic devices implementing the MIDI (Musical Instrument Digital Interface) standard, electronic music instruments of many kinds are now in widespread use. An introduction to the techniques commonly used in the synthesis and transformation of sound and which form the basis of digital sound processing for music is presented in Digital Sound Processing for Music and Multimedia by Ross Kirk and Andy Hunt, Focal Press (1999), ISBN: 0240515064.

Conventional electronic percussion instruments typically employ a sensor as illustrated at 101 in FIG. 1 that is acoustically coupled to a drum or drum-like striking surface 103 for producing a timing signal that is processed by a triggerable digital direct sound module 105. The timing signal may also be created by attaching a pickup device called a "drum trigger" to an existing acoustic drum. A drum trigger or other sensor typically employs a pressure responsive piezoelectric transducer coupled to an amplifier and peak detector for producing trigger signals that indicate the timing at which a drum stick strikes the surface of the drum. Commercially available "drum kits," such as the hi-hat electronic drum taught in Yamaha's U.S. Pat. No. 6,815,604, employ striking pads which simulate acoustic drumheads and other percussion instruments and employ striking surfaces that are struck with sticks (or striking rods). Striking intensities are detected by impact sensors such as piezoelectric transducers attached to the backs of the pads. The triggerable direct sound module 105 responds to each trigger signal by delivering an output signal to a conventional mixer and amplifier 107 connected to one or more loudspeakers 109. The output waveform produced by each striking event simulates, or is a recording of, the sound produced by the acoustic instrument being simulated. Triggerable direct sound modules are available from major manufactures such as Alesis, Roland, Yamaha and Kat.

In MIDI music systems, drum and other percussion sounds are simulated in response to a variety of trigger events, including keyboard events or drum pickups, which are converted into digital event signals conforming to the MIDI standard by a MIDI interface. A MIDI controllable sound module then produces digitized synthetic sound signals. A more description of an electronic percussion instrument of the type shown in FIG. 1 is presented in U.S. Pat. No. 5,293,000 issued to Alfonso Adinolfi on Mar. 8, 1994 entitled "Electronic Percussion System Simulating Play and Response of Acoustical Drum," the disclosure of which is incorporated herein by reference.

The sound produced by both acoustic and synthetic instruments can be modified and enhanced to achieve special effects by a technique called "convolution." Convolution, the integration of the product of two functions over a range of time offsets, and is a well known technique for processing sound. If an input sound signal is convolved with the impulse response of system (for example, the impulse response may represent the acoustic response of a particular orchestra hall), the signal produced by the convolution simulates the result that would occur if that sound signal had passed through a physical system with the same impulse response. Convolution has many known musical applications, including forms of spectral and rhythmic hybriding, reverberation and echo, spatial simulation and positioning, excitation/resonance modeling, and attack and time smearing.

The use of convolution in sound processing was presented as early as 1993 with the publication of the paper "Musical Sound Transformation by Convolution" by C. Roads, Proceedings of the International Computer Music Conference 1993, Waseda University, Tokyo. That paper contained an explanation of the theory and mathematics of convolution and included a survey of compositional applications of the technique as a tool for sound shaping and sound transformation. More recently, Roads described the uses of convolution in his book, The Computer Music Tutorial, MIT Press, 1996, pages 419-432 of which are devoted to convolution. Convolution has been used to create synthetic drum sounds.

Libraries of recordings of different acoustic drum sounds, recorded in an anechoic room, that can be triggered, for example, by a MIDI keyboard, are available. Many different versions of the same drum sounds are created by convolving the drum sounds with different recorded impulse responses exhibited by different rooms, or taken with different microphone locations in the room. The selection and combination of different drum sounds and different room characteristics as well as different microphone and instrument locations can be accomplished using available sound production software that includes the ability to convolve recorded sounds with the impulse response of different environments. See, for example, Larry Seyer Acoustic Drums for the GIGASTUDIO 3.0, Larry Seyer Productions, 2004.

All of the synthetic percussion instruments described above employ the same basic principle and suffer from a common disadvantage. Each sound or each simulated drum impact is initiated by a sensed or MIDI trigger event, indicating the timing of a drums stick impact or striking a key on a keyboard. When a striking surface is used, the output from the piezoelectric sensors is processed by peak detection to identify the trigger events. Thus, most of the information content of the signal from the impact sensor is largely discarded and only the event timing information is extracted to initiate the playback of a stored impact response.

As an example, U.S. Pat. No. 4,939,471 issued to Werrbach on Jul. 3, 1990 entitled "Impulse detection circuit" describes a triggering circuit for detecting drum beats within background noise and then triggering music synthesizers in response to the drum beat. As described in the Werrbach patent, differentiators, peak-rectifiers and filters are used to detect impulse like inputs over a wide dynamic range in a noisy background. The input signal is rectified and differentiated and then passed through a peak-rectifier and filter having a fast charging and a slow discharging time constant. The response of such triggering circuits is intentionally made highly-nonlinear in order to extract the only timing of substantial impacts on a drum pad surface, rejecting all other signals as being unwanted noise. As a result, the performer loses the ability to create and control many of the sounds and subtle effects that can be created with an acoustic instrument.

SUMMARY OF THE INVENTION

It is an object of the present invention to produce synthetic percussion sounds by a process that more accurately replicates the sound produced by an acoustic percussion instrument and that preserves the percussionist's ability to create sounds that can be created with an acoustic instrument using the same performance techniques used with an acoustic instrument.

In one embodiment, the present invention takes the form of an electronic percussion instrument that simulates the sound of a particular acoustic instrument. To play the instrument, the performer strikes, scrapes or rubs the playing surface of an object. A sensor is acoustically coupled to the object for producing a first signal waveform representative of the forces impacting the object. A second waveform representing the recorded response of the particular acoustic instrument to a single impact is convolved with the first waveform; that is, the product of the first and second waveforms are integrated in real time to form an output signal which represents the desired output sound. The resulting sound replicates the sound that would have been produced had the striking forces which impacted the object playing surface instead had impacted the acoustic instrument.

To insure that resonances and response characteristics of the performance pickup device (i.e., the object used to create the playing surface and the transducer and associated electronics), the stored acoustic instrument impulse response waveform may be filtered in advance, or the output signal from the pickup device may be filtered, to cancel out such resonances and response characteristics. In one embodiment, the output from the pickup device, or the stored acoustic instrument impulse response, may be deconvolved with the impulse response of the pickup device.

As explained above in the background section, conventional electronic drum kits trigger sample playback when a hit creates a spike of sufficient magnitude from a contact transducer. In addition, various methods are used to determine the location of the hit on the drum head, and waveform samples are mixed in various ways to recreate a range of sounds. However, these techniques miss the smaller scrapes and hits that are important in acoustic drum playing and do not allow the percussionist to rub the drum with brushes to obtain the effect of rubbing an acoustic drum surface. Moreover, the full spectral information the characterizes the impacts with the surface is not used to modify the output. For example, hitting a drum pad with a foam mallet would sound the same as hitting the pad with a hard stick. The present invention eliminates these problems by creating an output sound that is directly responsive to the complexities of the contact forces acting on the striking surface.

BRIEF DESCRIPTION OF THE DRAWINGS

In the detailed description which follows, frequent reference will be made to the attached drawings, in which.

DETAILED DESCRIPTION

The preferred embodiment of the invention described below allows a percussionist to make sounds that can not be made with current electronic drum technology. Light brushes, scrapes, and the timbres of the hits on an acoustic instrument are important elements of a percussionist's performance but are often ignored by conventional synthetic percussion devices. Embodiments of the present invention allow a percussionist to "play" a physical object, and the impact forces acting on the object are sensed by a direct contact transducer and processed to create a resulting sound as if the percussionist had played a selected acoustic instrument. For example, the player could play a drum pad with a drum brush, and sensed signal from the pad may be processed to sound like a brush against a cymbal. Brighter hits result in brighter sounds, and small taps and scrapes on the sensing surface sound like the same taps and scrapes played on a cymbal.

Figure 2:
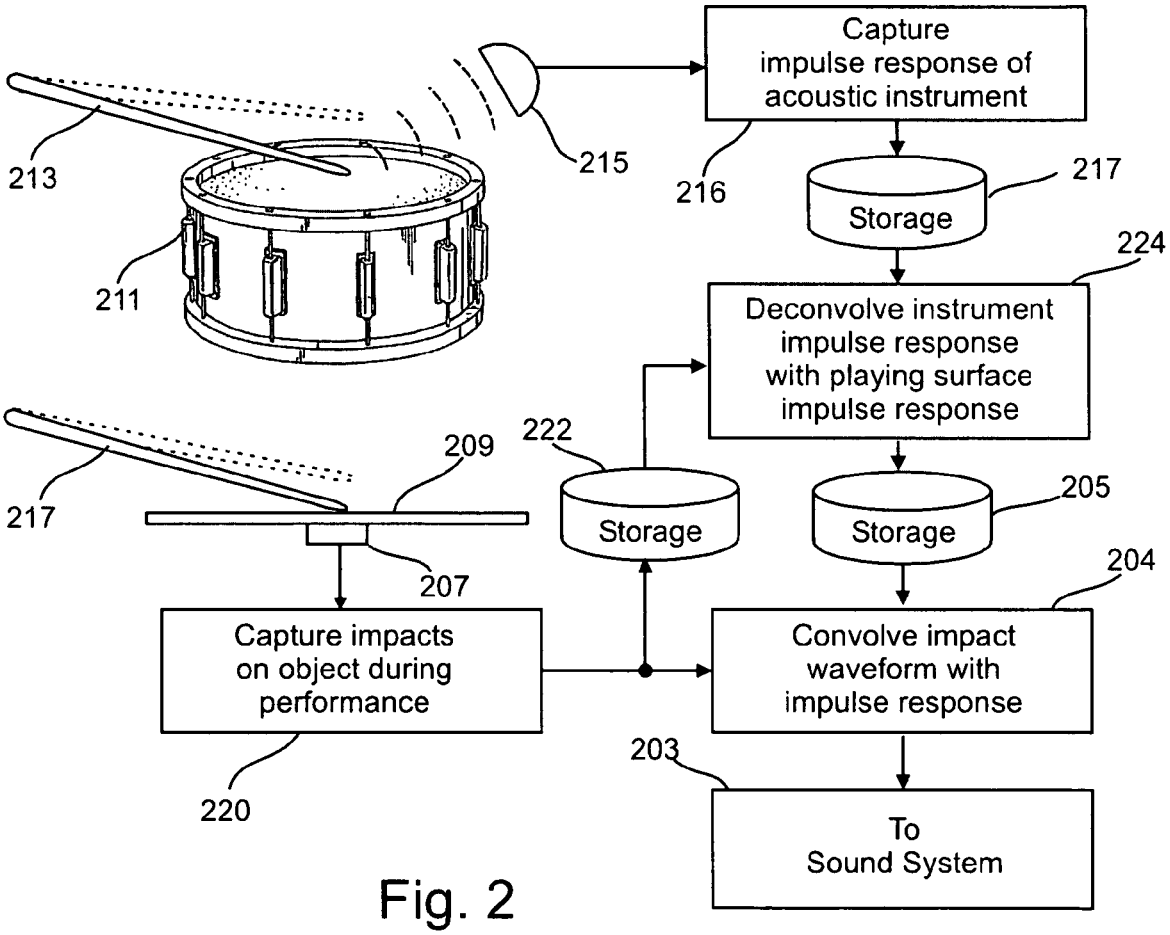
FIG. 2 is a schematic block diagram illustrating an electronic percussion synthesizer employing the invention.

As illustrated in FIG. 2, the preferred embodiment of the invention forms an output signal delivered to a sound system 203 by employing a signal processor to perform the step shown at 204 of convolving waveform data stored at 205 with a waveform captured by a transducer 207 that senses the forces impacting a physical object 209 that defines a playing surface.

The waveform data stored at 205 represents the impulse response of an acoustic percussion instrument and its surroundings as illustrated at 211. The stored impulse response may be produced and stored by recording the sound produced when the instrument 211 is tapped once using a stick 213. A microphone 215 captures the sound from the instrument 211 which is then amplified and digitized by conventional means (using a sampling circuit in combination with an analog-to-digital converter) as indicated at 216 to produce stored digital waveform data that is stored at 217 for further processing at 224 (explained below) before it is persistently stored at 205. The data stored at 205, which may be compressed in conventional ways, represents a series of amplitudes of the sound waveform from the microphone 215 taken at a sampling rate of at least twice the highest frequency to be replicated in the resulting sound. The sampling rate used should match the rate at which the vibratory signal from the transducer 207 is taken. A sampling rate of 44,100 samples per second, the rate at which CD's are encoded, can reproduce frequencies up to 22,050 Hz, well above the 20,000 Hz limit of human hearing.

The impact that produces the impulse response waveform stored at 205 should be an impulse; that is, should be a force that has a very short duration. The idealized impulse has zero duration and infinite amplitude, but contains a finite amount of energy. In the context of the present invention, the impulse force that is applied to an acoustical instrument in order to capture its characteristics should be as short as possible, and may be applied by a single impact from a drumstick.

Figure 1:
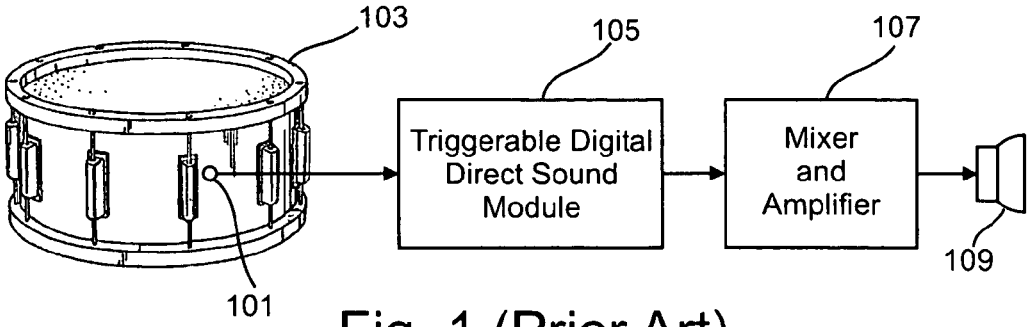
Fig. 1 (Prior Art)
FIG. 1 is schematic block diagram of a conventional electronic percussion instrument.

A rich variety of waveforms representing many different instruments may be recorded in different ways in different environments and placed in the storage device 205; for example, snare drums played in a small room, or kettle drums played in an orchestra hall, with different microphone placement in each case. Libraries of such "impulse response" data for many different acoustic percussion instruments and environments are available commercially for use with triggerable digital direct sound modules of the type described above in connection with FIG. 1, such as the libraries available from Larry Seyer Productions noted above. Note that, in the general case, the waveform data stored at 205 represents not only the impulse response of a particular acoustic instrument but the combined responses of both the instrument and the acoustic environment in which is played as sensed at the microphone 215. Alternatively, different recording environments and conditions (e.g. different locations of the microphone) may be simulated by convolving a recording of the instrument with the impulse response of a particular environment. As a consequence, multiple impulse responses may be stored at 205, and the performer may choose a particular impulse response to select the type of acoustic instrument and acoustic environment desired for a particular performance.

The transducer 207 is preferably a direct contact piezoelectric device placed in direct contact with an object 209 that defines a playing surface and the resulting waveform from the transducer 207 is a linear representation of impact, scrapping and/or rubbing forces applied to the surface when the object 209 is played as illustrated by the stick 217 striking the object 209. The object 209 may be any object which, in combination with the transducer 207, captures the tapping, scrapping or rubbing forces imparted by the performer. If desired, the object 209 and transducer 207 may be one of many such pickup devices such as a commercially available drum pad. Multiple striking surfaces and transducers may be arranged around the player and form a drum set, with the output from each drum pad potentially being convolved with a different impulse response to obtain a different sound from each pad. Multiple sensors may be attached at different positions on the same pad, with each transducer output being processed using a different impulse response. An example of such a drum set is disclosed in U.S. Pat. No. 6,815,604 issued to Jiro Toda (Yamaha Corporation) issued on Nov. 9, 2004 and entitled "Electronic Percussion Instrument," the disclosure of which is incorporated herein by reference. The physical device may be an actual percussion instrument equipped with a suitable sensor, such as a clip-on piezoelectric transducer that can be attached to an acoustic instrument, or a simulated instrument as described in the above-noted Adinolfi U.S. Pat. No. 5,293,000. In all cases, the sensor and any associated amplification circuitry seen at 220 should produce an output signal which is a linear representation of the impact forces applied to the object, rather than supplying a triggering or timing signal of the type used in conventional electronic drum simulation systems.

In some cases, the physical object 209 may have unwanted resonances or other undesired acoustic qualities. These undesired characteristics may not be objectionable when the pickup is used solely to produce timed trigger signals, but when it is desired to produce a linear representation of the actual forces imparted to the surface during play, it is desirable to compensate for these effects. This may be done by pre-processing the waveforms stored at 205 as indicated at 224 by filtering to remove unwanted resonances with the transducer 207 and object 209. This filtering may accomplished by deconvolving each waveform stored at 217 as indicated at 224 before the waveform is placed in the storage unit 205. The waveform from 217 is deconvolved with the impulse response of the physical object 209 and sensor 207. This, in effect, cancels out any unwanted response characteristics that might otherwise be created by the physical object and permits invention to be implemented by a wide range of playing surfaces. Note that the acoustic instrument waveform(s) stored at 217 are obtained by recording the output from an acoustic instrument, and may be obtained from an available library of waveforms from an available source. The waveforms in the store 217 are independent of the performance instrument. The processing that takes place at 224 however is a special filtering operation that compensates for the behavior of the physical playback instrument (physical object 209 and transducer 207).

To perform this filtering function at 224, the physical object is hit with a momentary impact and its impulse response is captured at the output of 220 and placed in the storage device 222. Each impulse response captured from an acoustic device as stored at 217 is then deconvolved at 224 with the impulse response of the physical playing object (e.g. a drum pad) 209. The deconvolution may be performed before the impulse response waveform from the acoustic instrument is placed in the store 205 as shown in FIG. 2. Alternatively, the impulse response stored at 222 may be deconvolved with the captured impact waveform at the output of 220 in real time. This, in effect, removes the effects contributed by the response of the physical object 209 and the transducer 207 and creates an accurate representation of the impact forces applied to the surface of object 209 during a performance. However, this real time filtering of the output from the transducer 207 places an additional computational burden on the processor at performance time, whereas deconvolving the stored acoustic instrument waveforms in advance need be performed only once on the smaller instrument impulse response files.

Note also that a switching or mixing system may be used to switch between or convolve two or more different stored waveforms with the impact signal from the transducer 207. For example, simple damping may be implemented by running two convolutions at once, one of a damped target sound, and the other of an undamped sound. A sensor may then be used to detect if the player's hand is touching the playing surface and crossfade to the damped sound if it is. Thus, if the player hits the playing surface normally, it "rings" in accordance with the undamped waveform, or if the player hits and then holds the playing surface, the output sound is damped.

The waveform data that is representative of a desired sound, such as a recording of the impulse response of a particular acoustic instrument located in a desired acoustic environment, is convolved with the output of the transducer 204 by the processor 204 using a convolution algorithm. The terms "convolve" and "convolution" as used herein refer to a signal processing operation consisting of the integration of the product of waveform signals that vary over time. Convolution in the time domain is equivalent to multiplication in the frequency domain and is a powerful, commonly used and well known digital signal processing technique described, for example, in Chapter 6 of "The Scientist and Engineer's Guide to Digital Signal Processing" by Steven W. Smith, California Technical Publishing, ISBN 0-9660176-3-3 (1997). Convolution when performed in real time, as it is in the present invention, should be performed by an efficient digital algorithm, such as the accurate and efficient algorithm exhibiting low latency described in U.S. Pat. No. 5,502,747 issued to David McGrath (Lake DSP pty Ltd.) on Mar. 26, 1996, the disclosure of which is incorporated herein by reference.

The term "deconvolution" as used herein refers to any of several kinds of processes that remove or attempt to remove the effects of a transfer circuit having an known impulse response, or the effects of convolution of an input signal with a known impulse response. As discussed earlier, convolving an input signal with the impulse response of a transfer circuit produces the output signal that would be formed by passing that input signal through the transfer circuit. In the same way, deconvolving a given signal with the input response of a transfer circuit recreates the input signal that would have been applied to the transfer circuit in order to produce the given signal. Thus, deconvolving the output signal at the output of 220 with the impulse response of the striking surface and transducer 207 creates a waveform that represents the impact forces striking the object 209, but without any distortions or resonances that might otherwise have been introduced by the physical object 209 or the transducer 207. Deconvolution as a means the cancellation of the effect of transfer circuit on an input signal is well known per se, and is described for example in U.S. Pat. No. 5,185,805 issued to Chiang on Feb. 9, 1993 entitled "Tuned deconvolution digital filter for elimination of loudspeaker output blurring," the disclosure of which is incorporated herein by reference.

The principles of the present invention may be applied to advantage to improving the performance and fidelity of a variety of instruments and musical systems, including electronic drum kits, hand percussion instruments for producing synthetic sounds, assorted auxiliary percussion devices, or to systems that connect to existing instruments or other objects of the player's choosing, including clip-on transducers that connect to an acoustic drum set.

CONCLUSION

It is to be understood that the methods and apparatus which have been described above are merely illustrative applications of the principles of the invention. Numerous modifications may be made by those skilled in the art without departing from the true spirit and scope of the invention.

What is claimed is:

1. An electronic percussion instrument for simulating the sound of a particular acoustic instrument comprising, in combination, a memory device for storing a first signal waveform representative of the sound produced by said particular acoustic instrument when impacted by a momentary striking force, an object defining a playing surface, a sensor acoustically coupled to said object for producing a second signal waveform which is a linear representation of the magnitude of the impact forces applied to the playing surface of said object when repetitively struck, scraped or rubbed, signal processing means for integrating the product of said first and second signal waveforms to produce an output waveform, and means for reproducing said output waveform as an output sound.

2. An electronic percussion instrument for simulating the sound of a particular acoustic instrument as set forth in claim 1 wherein said memory device stores said first signal waveform as a first digital signal, wherein said second signal waveform is digitized as a second digital signal, and wherein said signal processing means is a digital processor for integrating the product of said first and second digital signals.

3. An electronic percussion instrument for simulating the sound of a particular acoustic instrument as set forth in claim 1 further including means for filtering one of said waveforms to compensate for undesired signal response characteristics of the combination of said object and said sensor.

4. An electronic percussion instrument for simulating the sound of a particular acoustic instrument as set forth in claim 3 wherein said means for filtering comprises:

means for capturing and storing a third digital signal representing the impulse response of the combination of said object and said sensor, and, signal processing means for deconvolving said first or said second digital signal with said third digital signal to reduce the affects of the response of said object and said sensor on said output waveform.

5. An electronic percussion instrument for simulating the sound of a particular acoustic instrument as set forth in claim 4 wherein said sensor is a piezoelectric transducer attached in direct contact with said object.

6. An electronic percussion instrument for simulating the sound of a particular acoustic instrument as set forth in claim 5 further including signal processing means for deconvolving said first or said second signal waveform with the impulse response of the combination of said object and said piezoelectric transducer to reduce the affects of the response of said object and said piezoelectric transducer on said output waveform.

7. An electronic percussion instrument for simulating the sound of a particular acoustic instrument as set forth in claim 1 further including signal processing means for deconvolving said first or said second signal waveform with the impulse response of the combination of said object and said sensor to reduce the affects of the response of said object and said sensor on said output waveform.

8. The method of simulating the sound of an acoustic percussion instrument comprising, in combination, the steps of:

recording a first waveform signal representative of the sound produced by said acoustic percussion instrument when said acoustic percussion instrument is subjected to a momentary impact, detecting and recording a second waveform signal that is a continuous linear representation of the magnitude of the forces applied to a physical object when said physical object is repetitively struck, scrapped or rubbed by a human performer, employing a signal processor to integrate the product of said first waveform signal and said second waveform signal to create an output signal, and reproducing said output signal to simulate the sound of said acoustic percussion instrument.

9. The method of simulating the sound of an acoustic percussion instrument as set forth in claim 8 wherein said first waveform signal is a digital signal representing a first sequence of amplitudes of said sound produced by said acoustic instrument, wherein said second waveform signal is a digital signal representing a sequence of amplitudes of said forces, and wherein said signal processor performs the digital integration of the product of corresponding ones of said first and said second sequence of amplitudes.

10. The method of simulating the sound of an acoustic percussion instrument as set forth in claim 8 further comprising the step of deconvolving said first or said second signal waveform with the impulse response of the combination of said physical object and said sensor to reduce the affects of the response of said physical object and said sensor on said output signal.

11. The method of simulating the sound produced by an acoustic instrument comprising the steps of:

repetitively striking a surface coupled to a transducer to produce an output signal waveform having a magnitude substantially proportional to the magnitude of the impact forces impinging upon said surface, and convolving said output signal waveform with the impulse response of said acoustic instrument to form an output waveform which simulates the sound that would be produced by said impact forces impinging on said acoustic instrument.

12. The method of simulating the sound produced by an acoustic instrument as set forth in claim 11 wherein said surface coupled to a transducer is a drum pad and an attached piezoelectric transducer.

13. The method of simulating the sound produced by an acoustic instrument as set forth in claim 11 wherein said step of convolving comprises integrating the product of said output signal waveform and said impulse response.

14. The method of simulating the sound produced by an acoustic instrument as set forth in claim 11 wherein said impulse response waveform is a recording of the sound made by said acoustic instrument when struck by a single momentary impact.

15. The method of simulating the sound produced by an acoustic instrument as set forth in claim 11 further including the step of deconvolving said output signal with the impulse response of the combination of said surface and said transducer to reduce the affects of the response of said surface and said transducer on said output waveform.

* * * * *